United States Patent [19]

Saunders

[11] Patent Number: 4,584,777

[45] Date of Patent: Apr. 29, 1986

[54] BOW SIGHT

[76] Inventor: Charles A. Saunders, 8380 - 36th Ave., Columbus, Nebr. 68601

[21] Appl. No.: 702,884

[22] Filed: Feb. 19, 1985

[51] Int. Cl.[4] ..... F41G 1/00

[52] U.S. Cl. ..... 33/265; 124/87

[58] Field of Search ..... 33/265, 241–243; 124/87, 24 R

[56] References Cited

U.S. PATENT DOCUMENTS

| | | | |
|---|---|---|---|
| 1,961,517 | 6/1934 | Klopsteg | 33/265 |
| 2,610,405 | 9/1952 | Dickinson | 33/243 |
| 3,271,863 | 9/1966 | Harrington | 33/265 |
| 3,574,944 | 4/1971 | Reynolds | 33/265 |
| 3,693,262 | 9/1972 | Wood | 33/265 |
| 3,718,979 | 3/1973 | Allen | 33/265 |
| 3,787,984 | 1/1974 | Bear et al. | 33/265 |
| 3,800,424 | 4/1974 | Saunders et al. | 33/265 |
| 3,811,195 | 5/1974 | Carella | 33/265 |
| 4,026,032 | 5/1977 | Smith | 124/87 |
| 4,120,096 | 10/1978 | Keller | 33/265 |
| 4,495,705 | 1/1985 | Kowalski et al. | 33/265 |

*Primary Examiner*—Charles Frankfort
*Attorney, Agent, or Firm*—Henderson & Sturm

[57] ABSTRACT

An archery sight for attachment to a bow for facilitating proper vertical and lateral alignment of a bow shot with respect to targets at different distances. A base housing is adapted to be attached to a bow handle and an elongated member is operably attached to the base housing. A plurality of sight reference point structures are operably attached to the elongated member for alignment in the line of sight between an archer and targets disposed at respective distances from the archer for causing an arrow shot from the bow to strike such respective targets when released under proper alignment conditions. A structure is provided for selectively pivoting the elongated member about a longitudinal axis of a first one of the sight reference point structures for adjusting the distance that the other sight reference point structures will be disposed vertically from the first sight reference point structure. The elongated member can be then locked into whatever position is desired. A vertical adjustment mechanism is also operably connected to the pivoting mechanism and to the housing for adjusting the vertical position of the first sight reference point with respect to the housing. Additionally, a lateral adjustment mechanism is operably attached to the housing and to the pivoting structure for adjusting a lateral position of the elongated member and thereby of all of the sight reference point structures with respect to the housing.

12 Claims, 11 Drawing Figures

BOW SIGHT

TECHNICAL FIELD

The present invention relates generally to archery and more particularly to a sight for a bow which can be set to be used at various distances by a very simple and speedy procedure.

BACKGROUND ART

In the field of archery, it is common that sights are attached to bows for permitting an archer to align the sight with a target to increase accuracy. Sights of this type require that the reference sighting point of such a sight must be adjustable both vertically and laterally with respect to the handle. One of the most common types of sights used in this field is a plate which attaches to one side of the handle of a bow above the arrow rest of such bow and on the opposite side of the handle from the arrow rest. A pair of slots in such plate are vertically disposed when the bow is in a shooting position. Pins having a reference point on the end thereof are secured within such slots and to such plate. Each individual pin is adjustable by a threaded mechanism to be adjustable laterally and these pins can be tightened or loosened to the bracket and thereby made to be adjustable vertically by moving it in the slot to the desired position and then tightening such pin structure to the bracket when it is in the position desired.

It is common for an archer to have more than one of such pins on such a sight and typically these sight pins are individually adjusted in ten yard increments, although other increments are used from time to time. For each distance an archer typically will set a first pin, for example a 20 yard pin, roughly and then shoot it at a target which is at a distance of twenty yards. If the arrow flies higher than the target, then the pin is moved upwardly on the sight bracket. If the arrow strikes below the target, then the sight pin is moved downwardly on the bracket. Similarly, if the arrow hits the target to the left of the bullseye, the pin will be moved to the left and, conversely, if the arrow strikes to the right of the bullseye, then the pin will be moved to the right. This procedure is continued until the arrow strikes the target precisely at the point where the archer is aiming. Once this has been done at one distance, then the procedure needs to be repeated for each other pin corresponding to each other respective distance that the archer wishes to shoot.

Various other archery sights have been devised, such as the one shown in U.S. Pat. No. 3,800,424 to Saunders et al. A common problem, however, with prior art sights is that each reference aiming point must be individually set, and this procedure is not only tedious and time consuming, but is sometimes impractical; for example when a bow is being sighted in indoors and no more than thirty yards is available for such sighting-in procedure.

Consequently, there is a need for an archery sight which will solve the aforementioned problems.

DISCLOSURE OF THE INVENTION

The present invention relates to an archery sight for attachment to a bow for facilitating proper vertical and lateral alignment of a bow shot with respect to targets at different distances. A base housing is adapted to be attached to a bow handle and an elongated member is operably attached to the base housing. A first sight reference point structure is operably attached to the elongated member for alignment in the line of sight between an archer and a target disposed at a first distance from the archer for causing an arrow shot from the bow to strike such target at the desired place when released under proper alignment conditions. A second sight reference point structure is attached to another portion of the elongated member for alignment in the line of sight between the archer and a target disposed at a second distance from the archer for causing an arrow shot from the bow to strike the target disposed at the second distance when the arrow is released under proper alignment conditions. Other sight reference point structures can be attached to other portions of the elongated member for providing sight reference points for other distances. A structure is provided for selectively pivoting the elongated member about a longitudinal axis of the first sight reference point structure for adjusting the distance that the second sight reference point structure will be disposed vertically from the first sight reference point structure. The elongated member can be then locked into whatever position is desired. A vertical adjustment mechanism is also operably connected to the pivoting mechanism and to the housing for adjusting the vertical position of the first sight reference point with respect to the housing. Additionally, a lateral adjustment mechanism is operably attached to the housing and to the pivoting structure for adjusting a lateral position of the elongated member and thereby of all the sight reference point structures with respect to the housing.

An object of the present invention is to provide an improved sight for archery bows.

Another object of the present invention is to provide a sight whereby one pin can be set for one distance and once the proper vertical and lateral adjustments are made, then if one other pin is set for vertical alignment only, the other pins will be automatically set for their respective distances.

A further object of the invention is to provide an archery sight of the aforementioned type which is simple to set and easy to use.

Other objects, advantages, and novel features of the present invention will become apparent from the following detailed description of the invention when considered in conjunction with the accompanying drawings.

BEST MODE FOR CARRYING OUT THE INVENTION

Figure 1:
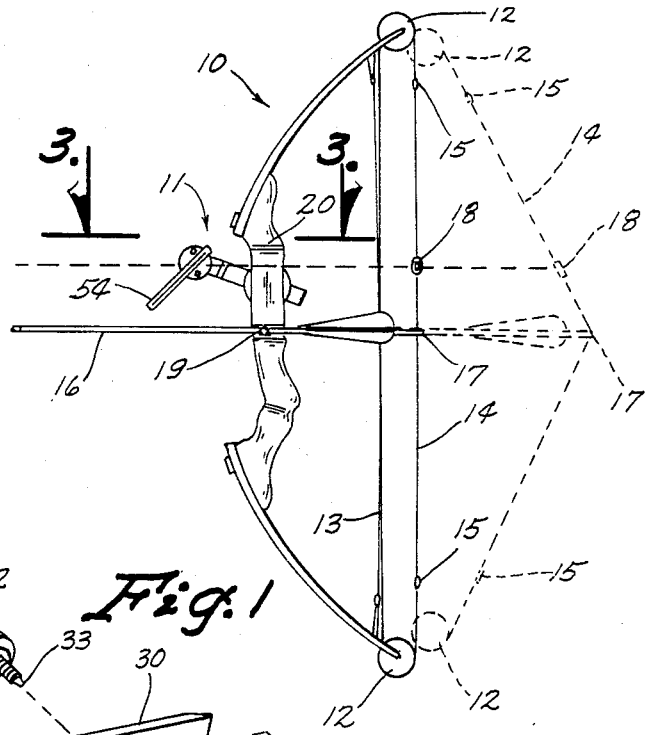
FIG. 1 shows an archery bow of the compound type having the sight of the present invention attached thereto.
Figure 4:
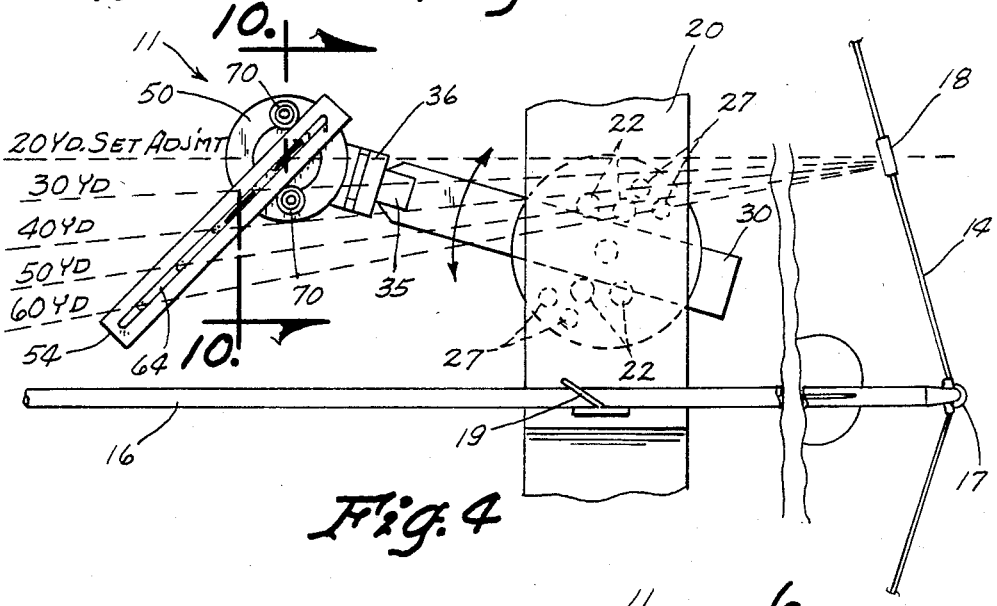
FIG. 4 is a view of the preferred embodiment of the present invention taken along lines 4—4 of FIG. 3 and showing the sighting pins set for certain distances.

Referring now to the drawings wherein like reference numerals designate identical or corresponding parts throughout the several views, FIG. 1 shows a compound bow (10) having a sight (11) constructed in accordance with the present invention attached to the handle thereof. The bow (10) is of a common type having eccentrically mounted wheels (12) attached to each end thereof and having a cable (13) extending around the wheels for providing a mechanical advantage, as is well known in this art. A string (14) is attached to the extreme ends of the cable (15) and an arrow (16) can be nocked to a nocking point or nock set (17) (FIG. 4). An optional peep sight (18) is shown attached to the string (14) above the nock set (17). An arrow rest (19) is attached to the handle (20) of the bow (10) for holding the arrow (16) in place so it can slide along beside the handle (20), for example as shown between solid and dashed lines in FIG. 1.

Figure 2:
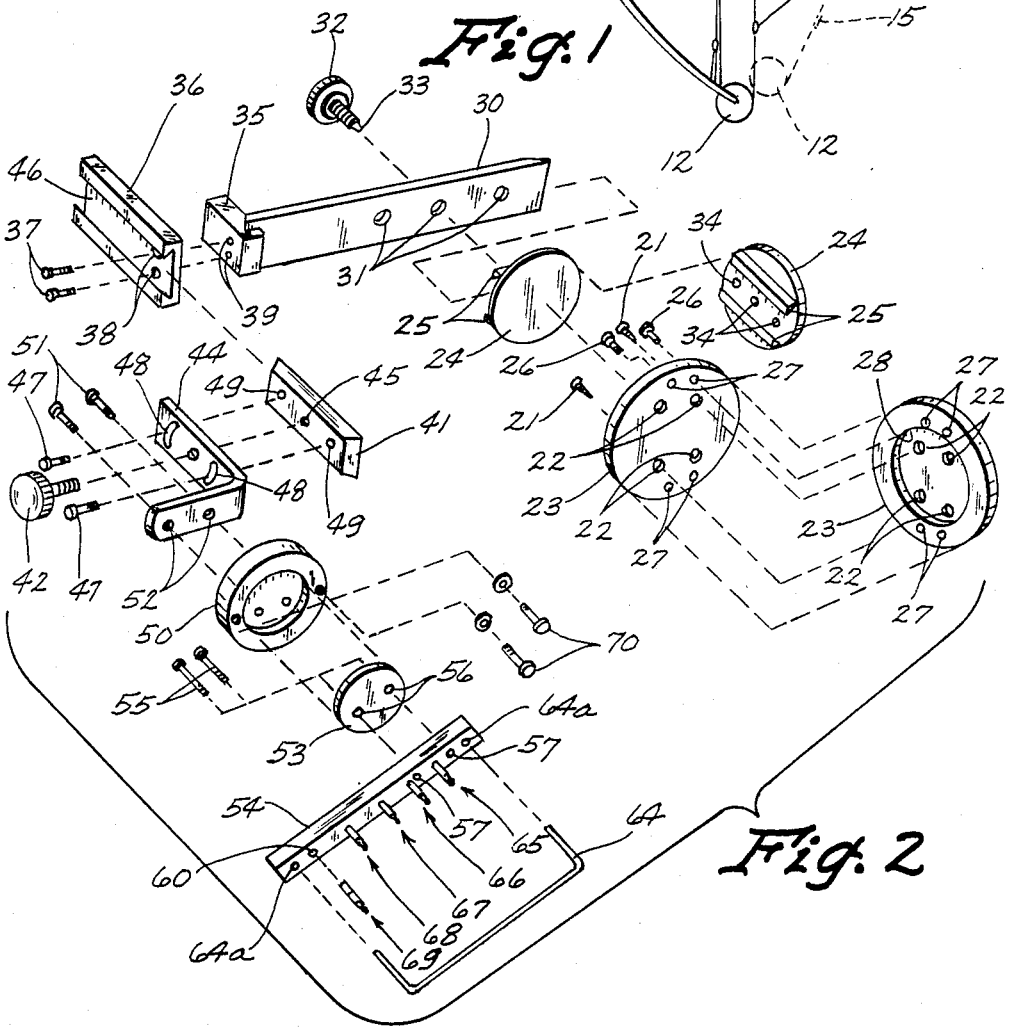
FIG. 2 is an enlarged, exploded, perspective view of the various parts of a preferred embodiment of the present invention.
Figure 3:
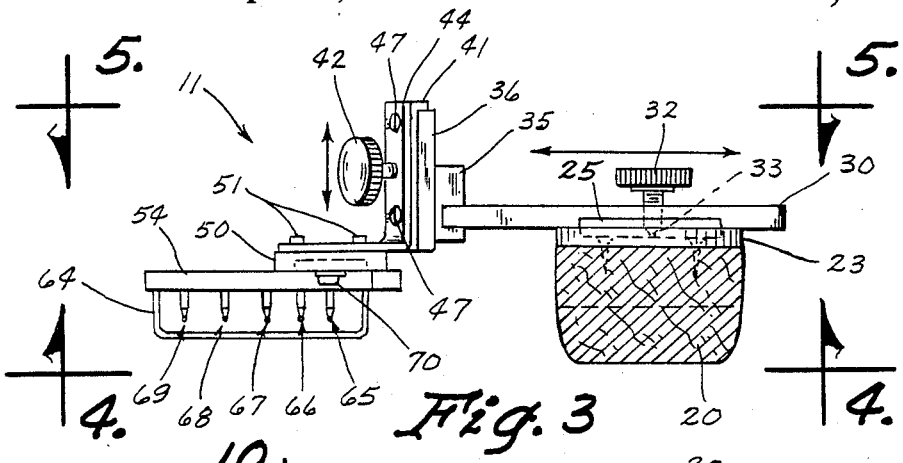
FIG. 3 is a top view taken along lines 3—3 of FIG. 1 of the preferred embodiment of the present invention.
Figure 7:
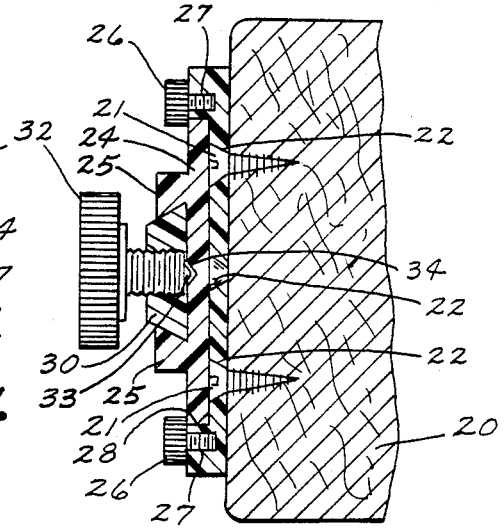
FIG. 7 is a cross sectional view taken along lines 7—7 of FIG. 5.

Typically, the handle (20) of most commercially available bows have a pair of openings spaced apart by a standard distance for receiving a pair of bolts or screws (21) as can be seen in FIGS. 2 and 7. These threaded fasteners (21) extend through two of the four openings (22) in the base housing (23). Four openings (22) are provided so that the sight is easily interchangeable between left hand and right hand bows, as will be clearly understood by those skilled in this art.

A disc (24) is disposed within an opening (28) in the member (23) after such base housing (23) has been attached to the bow handle (20). This disc (24) has a dovetail structure including a pair of rails (25). The disc (24) is held within the recess formed by rails (25) by a set of four locking screws (26) which are threadably engaged into threaded openings (27) on the base housing (23). An extension bar (30) is slidably received within the rails (25) whereby the extension bar (30) and the rails (25) form a dovetail type of connection therebetween. Three threaded openings (31) extend through the extension bar (30) and are adapted to threadably receive a locking screw (32). A locking screw (32) has an end (33) thereon adapted to be received in a selected one of the indexing recesses (34) in the pivotable disc (24) (see FIGS. 2 and 8).

The extension bar (30) has a connector member (35) rigidly attached to one end thereof. A stationary block (36) is attached to the connector member by threaded fasteners (37) which extend through openings (38) in the stationary block (36) and threadably engage into openings (39) in the connector member (35). A slide block (41) is of a shape that will slide into the dovetail shaped opening in the stationary block (36). A locking screw (42) slidably extends through an opening (43) in canted bow compensation bracket (44). The locking screw (42) is threadably engaged in a threaded opening (45) in the slide block (41), and this threaded opening (45) extends completely through the slide block (41) so that the end of the locking screw (42) can contact the surface (46) of stationary block (36) to selectively hold the slide block (41) and bracket (44) securely in place with respect to the stationary block (36) when desired or can be loosened to allow the slide block (41) and bracket (44) to slide in the dovetail slot (46).

A pair of threaded fasteners (47) extend through arcuate shaped openings (48) and are threadably attached to the slide block (41) by extending into threaded openings (49). When these fasteners (47) are tightened down against the bracket (44), the bracket (44) will not rotate about the axis of the locking screw (42); but when the threaded fasteners (47) are loosened, then the bracket (44) can be pivoted in one direction or the other by a small amount because of the presence of the arcuate shaped slots (48).

Figure 10:
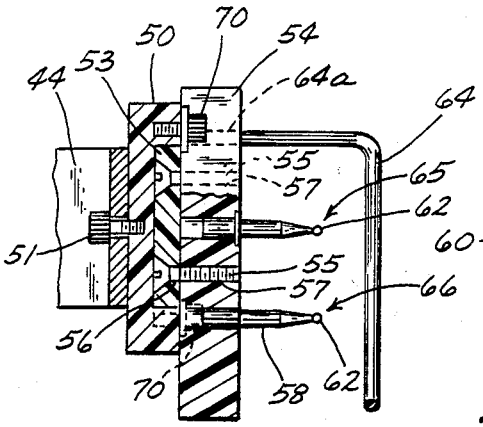
FIG. 10 is an enlarged partial cross sectional view taken along lines 10—10 of FIG. 4.

A sight bar rotary base (50) is rigidly attached to the bracket (44) by a pair of fasteners (51), as can best be seen in FIG. 2, wherein these threaded fasteners (51) extend through openings (52) in the bracket (44) and into threaded openings in the back of sight bar rotary base (50), as can best be seen in FIG. 10.

Figure 11:
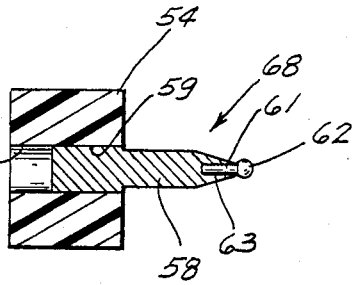
FIG. 11 is an enlarged, partial, cross sectional view taken along lines 11—11 of FIG. 6.

The elongated sight bar member (54) is rigidly attached to the sight bar rotary head (53) by fasteners (55) which extend through openings (56) in the rotary head (53) and are threadably engaged into threaded openings (57) in the sight bar (54). Referring now to FIGS. 10 and 11, it is noted that sight pins (58), which may be made of brass or other similar material, has one end thereof (59) which is press fit into an opening (60) in the elongated sight bar member (54). The other end of the sight pin (58) has a bore (61) disposed therein for receiving a spherically shaped sight reference point (62). This somewhat spherically shaped reference point structure (62) is made of a light gathering plastic such as BUTARATE. The spherically shaped portion (62) has a cylindrically shaped portion (63) connected thereto so that the cylindrically shaped portion will fit snugly into the opening (61) and will stay there, either by having a press fit or by using a glue to keep this plastic insert (62) and (63) in place. A pin guard (64) is press fit into openings (64*a*) in each end of the elongated sight bar member (54) for preventing the sight pins (58) from becoming bent or otherwise damaged, and for preventing the plastic reference point member (62) from being broken off. The plastic reference point structures (62) and (63) can be molded of different colors so that an archer will not confuse one pin for a certain distance with another pin for a different distance.

Figure 8:
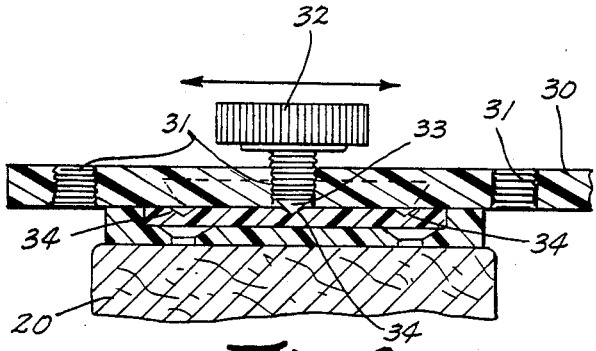
FIG. 8 is a cross sectional view taken along lines 8—8 of FIG. 5.
Figure 9:
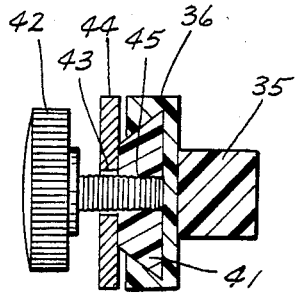
FIG. 9 is a cross sectional view taken along lines 9—9 of FIG. 6

When it is desired to use the sight (11) as shown in FIG. 1, and after the sight (11) has been attached to the bow handle (20) and all of the sight (11) has been assembled, the archer will decide how far the extension bar (30) is to extend from the handle (20) by threadably engaging the locking screw (32) into a chosen one of the threaded openings (31), as shown in FIGS. 2, 7 and 8. Then, the locking screw (32) is aligned with a chosen one of the locking recesses (34) to further adjust the distance that the extension bar (30) will extend outwardly from the handle (20). For example, as shown in FIG. 8, the end of the locking screw (32) extends into the central one of the locking recesses (34). Once set, the same locking recess must be used or the sight adjustment will be off.

Then, using the twenty yard pin (65) (or whatever other base distance is desired) an archer will shoot arrows to see if the arrows strike a target at the desired place when the target is twenty yards away, for example. If the arrows strike too high on the target, then the locking screws (26) will be loosened (FIG. 5) and the extension bar (30) will be rotated upwardly, for example as shown in FIG. 4. Of course, if the arrows strike the target too low, then the extension bar would be pivoted downwardly. In other words, the extension bar member (30) is moved upwardly or downwardly by first loosening the rotary bar locking screws (26) and adjusting the vertical extent of the twenty yard pin (65) until the proper vertical adjustment has been made, at which time the locking screws (26) are tightened down to prevent rotation of the extension bar (30) with respect to the base housing (23).

Figure 5:
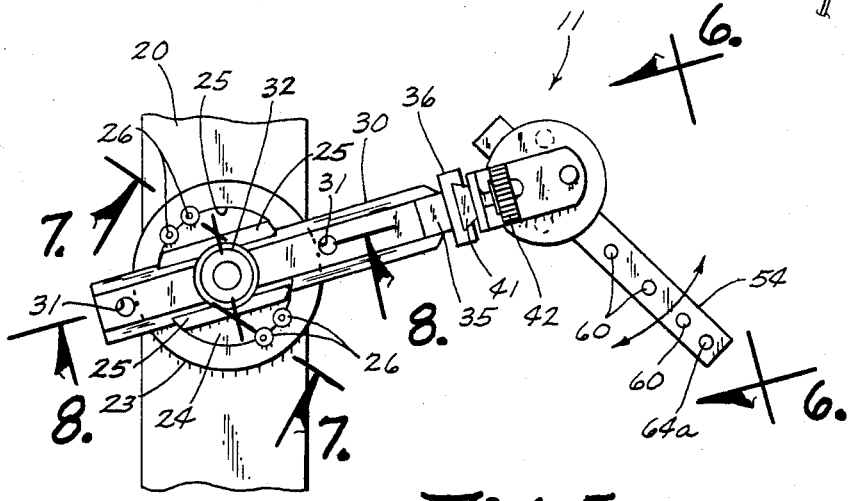
FIG. 5 is a side view of the preferred embodiment of the present invention as viewed along lines 5—5 of FIG. 3.
Figure 6:
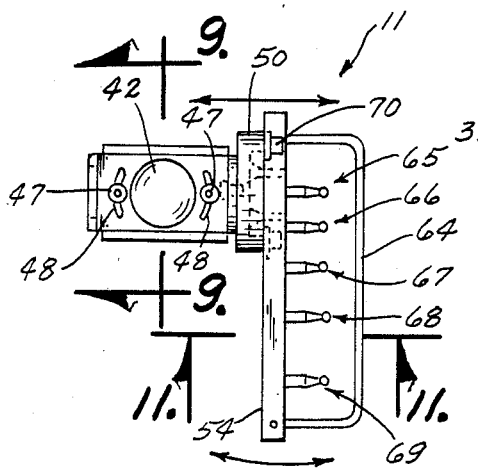
FIG. 6 is a front view of the preferred embodiment of the present invention as viewed along lines 6—6 of FIG. 5.

If the arrows are off to the right or left, a correction is made by loosening the sight bar locking screw (42) and sliding the slide block (41) to the left or right in the dovetail groove (46) until the proper lateral adjustment has been made. Once the twenty yard pin is "on target", another one of the pins (66–69) can be set. Typically, it is easiest to set the thirty yard pin (66) next. Consequently, arrows are shot at a target thirty yards away by aligning the thirty yard pin (66) with the target as is shown in FIG. 4. If the arrows fly too high, then the adjusting screws (70) are loosened so that the elongated sight bar (54) and sight bar rotary head (53) can pivot in the sight bar rotary base (50) about the longitudinal axis of the twenty yard pin (65). Consequently, if the arrows are flying too high while using the thirty yard pin, then the elongated sight bar member (54) would be pivoted in such a direction, for example as shown in FIG. 5, so that the thirty yard pin moves upwardly; and, conversely, if the arrows are flying too low, then the elongated sight bar member (54) is pivoted in the other direction such that the thirty yard pin will be moved downwardly with respect to the handle of the bow.

Once the thirty yard pin is "on target", then the locking bolts (70) are tightened down securely to prevent any more rotation of the elongated sight bar member (54) and its associated sight bar rotary head (53), with respect to the sight bar rotary base (50). No lateral adjustment will need to be made with respect to the thirty yard pin because that adjustment, having been made with respect to the twenty yard pin, will also apply to the thirty yard pin. Also, the forty yard pin (67), the fifty yard pin (68), and the sixty yard pin (69) will also be automatically set by the above noted procedures when only the twenty and thirty yard pins have been adjusted. This is due to the fact that the spherical reference point in (62) of each of the pins (65–69) are in a straight line with one another so that a lateral adjustment of one, will automatically adjust all of the rest of these pins, and the spacing between the pins (65–69) have been calibrated so that the distance between each successive pin is ever so slightly greater to compensate for the fact that the arrow is slowing down the farther it goes from the bow. Consequently, once the vertical adjustment has been made for the twenty yard pin (65) and any other one of the pins (66–69), the proper vertical setting will have automatically been made for the other pins, because these pins are fixed and not movable with respect to each other.

If it turns out that when shooting arrows at sixty yards that the arrows are slightly to the left or the right, but right on target at when using the twenty yard pin, the sight bar (54) can be canted by loosening the two sight bar adjustment screws (47) and pivoting the entire assembly, including the elongated sight bar member (54), slightly until a proper compensation has been made so that the arrows are on target laterally at the sixty yard distance. This will automatically make a similar compensation at the intermediate yardages so that no further adjustment will be necessary. The adjustment will not ordinarily need to be made unless the archer cants the bow from to one side or the other while shooting, rather than holding the bow completely vertically, or when the attachment plate surface where the base housing (22) attaches to the bow handle (20) is not completely square.

Obviously, many modifications and variations of the present invention are possible in light of the above teachings. It is therefore to be understood that within the scope of the appended claims, the invention may be practised otherwise than as specifically described.

I claim:

1. An archery sight apparatus for attachment to a bow for facilitating proper vertical and lateral alignment of a bow shot with respect to targets at different distances, said sight apparatus comprising:

a housing adapted to be attached to a bow;

an elongated member operably attached to said housing;

a first sight reference point means defining a first sight point, a substantially horizontal axis extending through said first sight point, said first sight reference point means being operably attached to said elongated member for alignment in the line of sight between an archer and a target disposed at a first distance from the archer for causing an arrow shot from the bow to strike the target when released under proper alignment conditions;

a second sight reference point means attached to another portion of said elongated member for alignment in the line of sight between an archer and a target disposed at a second distance from the archer for causing an arrow shot from the bow to strike the target disposed at the second distance when the arrow is released under proper alignment conditions;

means for selectively pivoting said elongated member about the substantially horizontal axis of the first sight point for adjusting the distance that the second sight reference point means will be disposed vertically from said first sight reference point means;

means for selectively locking said elongated member in any one of a number of desired pivotal positions;

vertical adjustment means operably connected to said pivoting means and to said housing for adjusting the vertical position of said horizontal axis of said first sight reference point means with respect to said housing; and lateral adjustment means operably attached to said housing and to said pivoting means for adjusting the lateral position of said elongated member and thereby said first sight reference point means with respect to said housing.

2. The archery sight apparatus of claim 1 wherein said vertical adjusting means comprises:

an extension member;

adjusting means for pivotally attaching one end of said extension member along a second substantially horizontal axis to said housing, said extension member being operably attached to said pivoting means at the other end thereof; and means for selectively holding said extension member from pivoting once the first sight reference point means has been set for vertical alignment.

3. The archery sight apparatus of claim 1 further comprising:

a plurality of other sight reference point means attached to said elongated member at calibrated distances from the first and second sight reference point means for alignment in the line of sight between an archer and targets disposed at other respective distances from the archer for causing an arrow shot from the bow to strike a respective target at such respective distances when aligned with a respective sight pin means and released under proper alignment conditions.

4. The archery sight of claim 3 wherein each of said sight reference point means comprises an elongated pin member attached to said elongated member at one end thereof and having a somewhat spherically shaped structure disposed on the other end thereof for serving as a sighting reference point.

5. The archery sight of claim 4 wherein said elongated pin member has an opening in said other end thereof and said somewhat spherically shaped structure is composed of a light gathering material and having an extension portion thereon disposed in said opening in the elongated pin member for holding the spherically shaped structure in place on the elongated pin member.

6. The archery sight apparatus of claim 5 wherein said light gathering material is BUTARATE plastic.

7. The archery sight apparatus of claim 6 including an adhesive material disposed in said opening and around said extension portion of the spherically shaped member for holding the spherically shaped member to the elongated pin member.

8. The archery sight apparatus of claim 2 wherein said lateral adjustment means comprises:

a connection member rigidly connected to the other end of the extension member, first slide means for selectively slidably attaching said pivoting means to said connection member for permitting the pivoting means and thereby said first and second sight reference point means to be adjusted laterally with respect to the housing; and means for selectively holding the pivoting means from sliding with respect to the connection member once the first sight reference point means has been set for lateral adjustment.

9. The archery sight apparatus of claim 3 wherein said plurality of other sight reference point means are disposed on said elongated member between said first and second sight reference point means in a predetermined spaced apart relationship with all of the sight reference point means being aligned in a straight line so that when the lateral adjustment is made for said first sight reference point means, the lateral adjustment is automatically made for all other sight reference point means.

10. The archery sight apparatus of claim 8 including a bow compensation means operably connected to said first slide means and to said pivoting means for permitting said elongated member to be pivoted about an axis transversely disposed with respect to the first said horizontal axis whereby a line extending through said first and second sight reference point means can be adjusted to be in a not precisely vertical orientation for archers who cant their bow during the sighting and shooting process or for bows having an attachment plate surface which is not square.

11. The archery sight apparatus of claim 2 including second slide means for adjusting the distance that the extension member extends from said second substantially horizontal axis.

12. The archery sight apparatus of claim 11 including:

means for permitting said extension member to be removed from said housing; and indexing means operatively disposed on said adjusting means for permitting the extension member to be easily reattached to the adjusting means at the same position as originally set.

* * * * *